US011639055B2

(12) United States Patent
Gardner et al.

(10) Patent No.: US 11,639,055 B2
(45) **Date of Patent: *May 2, 2023**

(54) FLUID EJECTION DEVICES INCLUDING CONTACT PADS

(71) Applicant: HEWLETT-PACKARD DEVELOPMENT COMPANY, L.P., Spring, TX (US)

(72) Inventors: James Michael Gardner, Corvallis, OR (US); Scott A. Linn, Corvallis, OR (US); Michael W. Cumbie, Corvallis, OR (US); Anthony M. Fuller, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/859,432

(22) Filed: Jul. 7, 2022

(65) Prior Publication Data

US 2022/0348013 A1 Nov. 3, 2022

Related U.S. Application Data

(63) Continuation of application No. 16/768,041, filed as application No. PCT/US2019/016726 on Feb. 6, 2019, now Pat. No. 11,413,865.

(51) Int. Cl.
*B41J 2/14* (2006.01)
*B41J 2/045* (2006.01)

(52) U.S. Cl.
CPC ..... *B41J 2/14072* (2013.01); *B41J 2/04501* (2013.01)

(58) Field of Classification Search
CPC ..... B41J 2/14072; B41J 2/04501; B41J 2/01; B41J 2/02; B41J 2/135; B41J 2/14; B41J 2/14008; B41J 2/14016; B41J 2/14201; B41J 2/14314
See application file for complete search history.

(56) References Cited

U.S. PATENT DOCUMENTS

| | | | |
|---|---|---|---|
| 8,110,899 | B2 | 2/2012 | Reed et al. |
| 8,960,860 | B2 | 2/2015 | Axtell et al. |
| 8,970,051 | B2 | 3/2015 | Shi et al. |
| 9,221,247 | B2 | 12/2015 | Cruz-Uribe et al. |
| 9,536,848 | B2 | 1/2017 | England et al. |
| 11,413,865 | B2 * | 8/2022 | Gardner ..... B41J 2/14072 |
| 2007/0206062 | A1 | 9/2007 | Malpica |
| 2007/0218588 | A1 | 9/2007 | Takiar et al. |
| 2007/0279448 | A1 | 12/2007 | Tsukuda |
| 2008/0024542 | A1 | 1/2008 | Miyazaki et al. |
| 2016/0001554 | A1 | 1/2016 | Chen et al. |
| 2017/0120590 | A1 | 5/2017 | Chen et al. |
| 2017/0259568 | A1 | 9/2017 | Dodd et al. |
| 2017/0368821 | A1 | 12/2017 | Fujii et al. |
| 2018/0111263 | A1 | 4/2018 | Van et al. |
| 2018/0226316 | A1 | 8/2018 | Chen et al. |

FOREIGN PATENT DOCUMENTS

| | | | |
|---|---|---|---|
| CN | 1701961 | A | 11/2005 |
| CN | 106315504 | A | 1/2017 |
| EP | 2965910 | A1 | 1/2016 |

* cited by examiner

*Primary Examiner* — Kristal Feggins
(74) *Attorney, Agent, or Firm* — Foley & Lardner LLP

(57) ABSTRACT

A device includes a first column of contact pads. The device also includes a column of fluid actuation devices disposed longitudinally to the first column of contact pads.

15 Claims, 4 Drawing Sheets

FLUID EJECTION DEVICES INCLUDING CONTACT PADS

CROSS-REFERENCE TO RELATED APPLICATIONS

This application is a Continuation Application of U.S. National Stage application Ser. No. 16/768,041, filed May 28, 2020, entitled "FLUID EJECTION DEVICES INCLUDING CONTACT PADS", which is a U.S. National Stage of PCT Application No. PCT/US2019/016726, filed Feb. 6, 2019, entitled "FLUID EJECTION DEVICES INCLUDING CONTACT PADS", both of which are incorporated herein.

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

In certain examples, it may be desirable to reduce the width of a semiconductor die or device including fluid actuation devices (e.g., a fluid ejection die) to reduce costs and improve manufacturability. In other examples, the design of the die may also be configured to operate with reduced logic power delivery. In one example, a device is provided with a contact pad arrangement that enables such relatively thin die and/or reduced logic power delivery. That said, the devices and contact pad arrangements discussed in this disclosure may be associated with other effects, which may or may not be addressed in this disclosure.

Accordingly, described herein is a device to enable fluid ejection, including contact pads arranged longitudinally with respect to the device. A first column of six contact pads may be arranged at one end of the device and a second column of six contact pads may be arranged at the other end of the device and aligned with the first column of contact pads. A column of fluid actuation devices may be arranged between the first column of contact pads and the second column of contact pads.

Figure 1A:
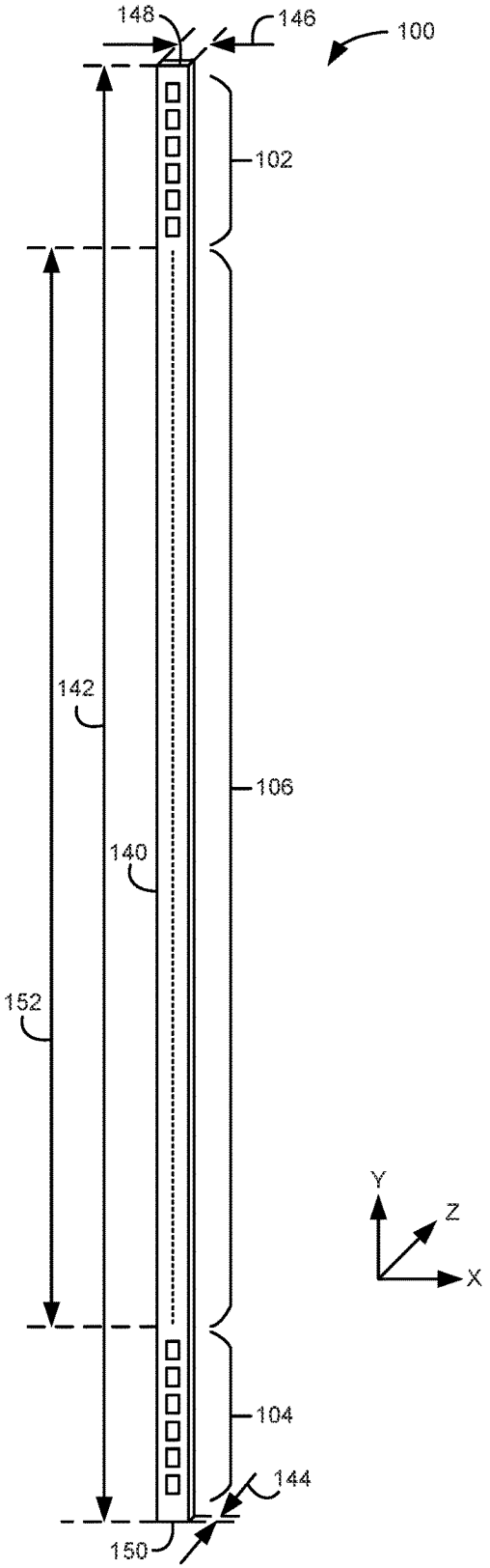
FIGS. 1A and 1B illustrate one example of a fluid ejection die.
Figure 1B:
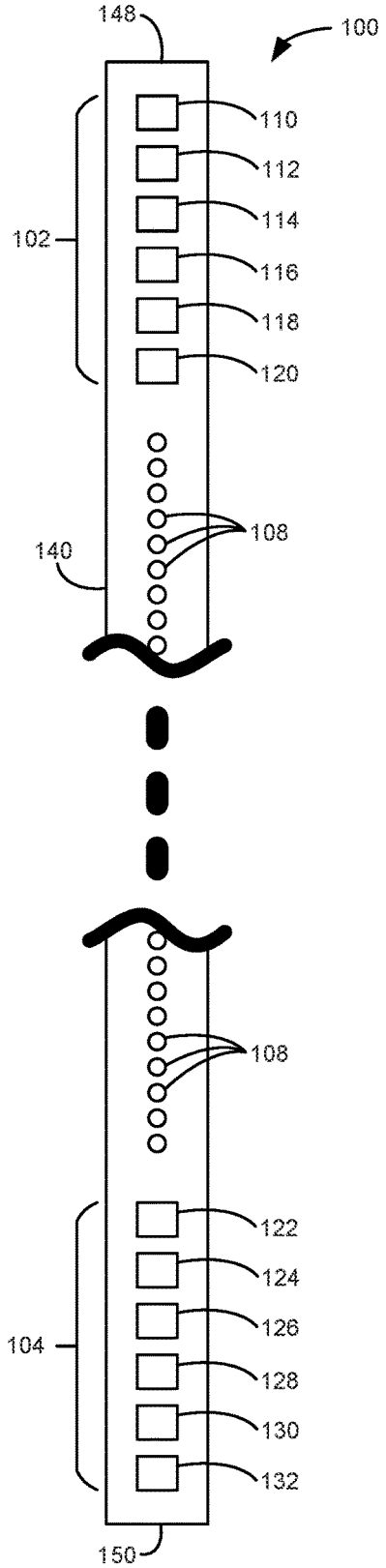

FIG. 1A illustrates one example of a fluid ejection die 100 and FIG. 1B illustrates an enlarged view of the ends of fluid ejection die 100. Die 100 includes a first column 102 of contact pads, a second column 104 of contact pads, and a column 106 of fluid actuation devices 108. The second column 104 of contact pads is aligned with the first column 102 of contact pads and at a distance (i.e., along the Y axis) from the first column 102 of contact pads. The column 106 of fluid actuation devices 108 is disposed longitudinally to the first column 102 of contact pads and the second column 104 of contact pads. The column 106 of fluid actuation devices 108 is also arranged between the first column 102 of contact pads and the second column 104 of contact pads. In one example, fluid actuation devices 108 are nozzles or fluidic pumps to eject fluid drops.

In one example, the first column 102 of contact pads includes six contact pads. The first column 102 of contact pads may include the following contact pads in order: a data contact pad 110, a clock contact pad 112, a logic power ground return contact pad 114, a multipurpose input/output contact pad 116, a first high voltage power supply contact pad 118, and a first high voltage power ground return contact pad 120. Therefore, the first column 102 of contact pads includes the data contact pad 110 at the top of the first column 102, the first high voltage power ground return contact pad 120 at the bottom of the first column 102, and the first high voltage power supply contact pad 118 directly above the first high voltage power ground return contact pad 120. While contact pads 110, 112, 114, 116, 118, and 120 are illustrated in a particular order, in other examples the contact pads may be arranged in a different order.

In one example, the second column 104 of contact pads includes six contact pads. The second column 104 of contact pads may include the following contact pads in order: a second high voltage power ground return contact pad 122, a second high voltage power supply contact pad 124, a logic reset contact pad 126, a logic power supply contact pad 128, a mode contact pad 130, and a fire contact pad 132. Therefore, the second column 104 of contact pads includes the second high voltage power ground return contact pad 122 at the top of the second column 104, the second high voltage power supply contact pad 124 directly below the second high voltage power ground return contact pad 122, and the fire contact pad 132 at the bottom of the second column 104. While contact pads 122, 124, 126,128, 130, and 132 are illustrated in a particular order, in other examples the contact pads may be arranged in a different order.

Data contact pad 110 may be used to input serial data to die 100 for selecting fluid actuation devices, memory bits, thermal sensors, configuration modes, etc. Data contact pad 110 may also be used to output serial data from die 100 for reading memory bits, configuration modes, etc. Clock contact pad 112 may be used to input a clock signal to die 100 to shift serial data on data contact pad 110 into the die or to shift serial data out of the die to data contact pad 110. Logic power ground return contact pad 114 provides a ground return path for logic power (e.g., about 0 V) supplied to die 100. In one example, logic power ground return contact pad 114 is electrically coupled to the semiconductor (e.g., silicon) substrate 140 of die 100. Multipurpose input/output contact pad 116 may be used for analog sensing and/or digital test modes of die 100.

First high voltage power supply contact pad 118 and second high voltage power supply contact pad 124 may be used to supply high voltage (e.g., about 32 V) to die 100. First high voltage power ground return contact pad 120 and second high voltage power ground return contact pad 122 may be used to provide a power ground return (e.g., about 0 V) for the high voltage power supply. The high voltage power ground return contact pads 120 and 122 are not directly electrically connected to the semiconductor substrate 140 of die 100. The specific contact pad order with the high voltage power supply contact pads 118 and 124 and the high voltage power ground return contact pads 120 and 122 as the innermost contact pads may improve power delivery to die 100. Having the high voltage power ground return contact pads 120 and 122 at the bottom of the first column 102 and at the top of the second column 104, respectively, may improve reliability for manufacturing and may improve ink shorts protection.

Logic reset contact pad 126 may be used as a logic reset input to control the operating state of die 100. Logic power supply contact pad 128 may be used to supply logic power (e.g., between about 1.8 V and 15 V, such as 5.6 V) to die 100. Mode contact pad 130 may be used as a logic input to control access to enable/disable configuration modes (i.e., functional modes) of die 100. Fire contact pad 132 may be used as a logic input to latch loaded data from data contact pad 110 and to enable fluid actuation devices or memory elements of die 100.

Die 100 includes an elongate substrate 140 having a length 142 (along the Y axis), a thickness 144 (along the Z axis), and a width 146 (along the X axis). In one example, the length 142 is at least twenty times the width 146. The width 146 may be 1 mm or less and the thickness 144 may be less than 500 microns. The fluid actuation devices 108 (e.g., fluid actuation logic) and contact pads 110-132 are provided on the elongate substrate 140 and are arranged along the length 142 of the elongate substrate. Fluid actuation devices 108 have a swath length 152 less than the length 142 of the elongate substrate 140. In one example, the swath length 152 is at least 1.2 cm. The contact pads 110-132 may be electrically coupled to the fluid actuation logic. The first column 102 of contact pads may be arranged near a first longitudinal end 148 of the elongate substrate 140. The second column 104 of contact pads may be arranged near a second longitudinal end 150 of the elongate substrate 140 opposite to the first longitudinal end 148.

Figure 2:
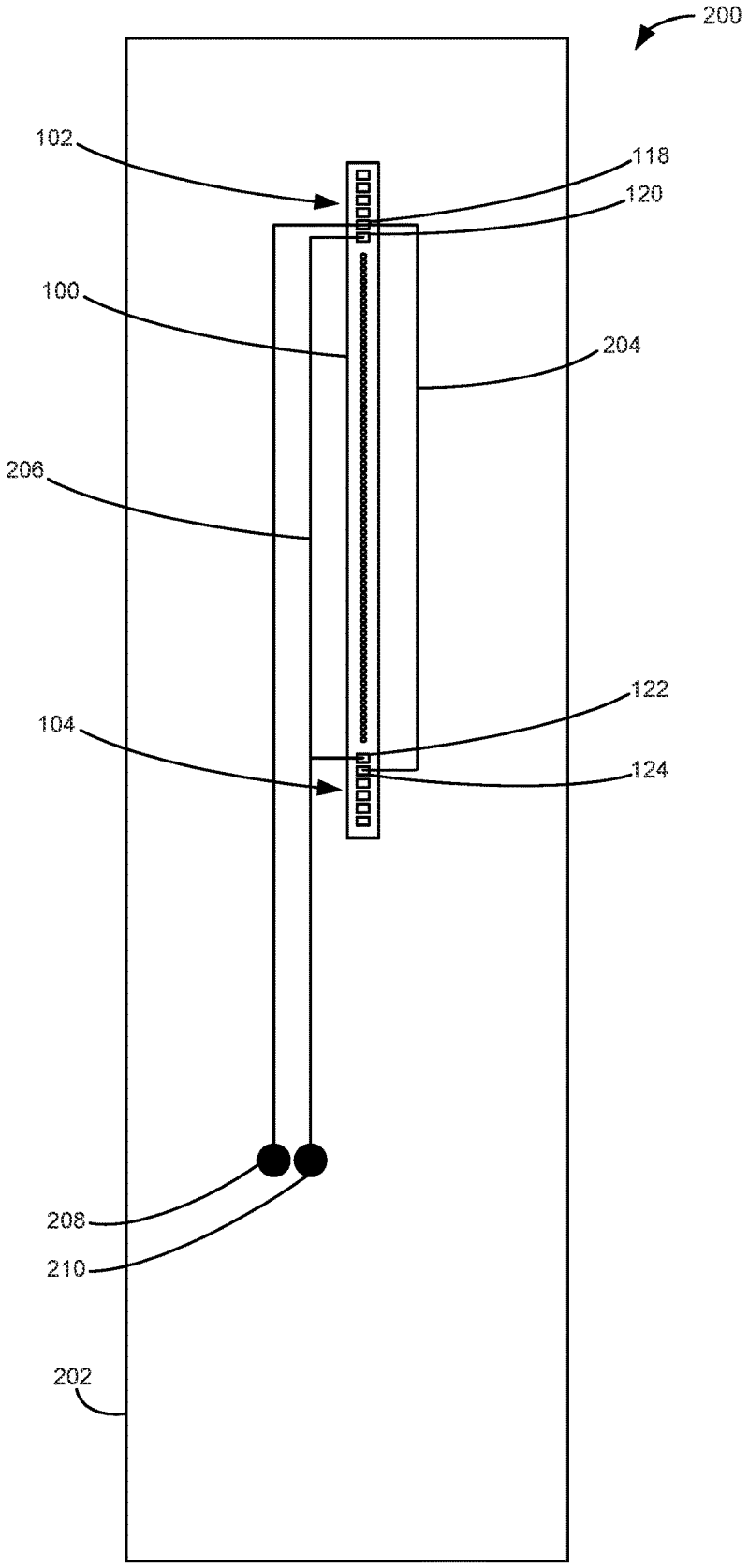
FIG. 2 illustrates one example of a portion of a fluid ejection device.

FIG. 2 illustrates one example of a portion of a fluid ejection device 200. In one example, fluid ejection device 200 is a printhead assembly for ejecting fluid of a single color (e.g., black). Fluid ejection device 200 includes a carrier 202 and a fluid ejection die 100. As previously described and illustrated with reference to FIGS. 1A and 1B, fluid ejection die 100 includes a plurality of first contact pads arranged in a first column 102 and a plurality of second contact pads arranged in a second column 104 aligned with the first column 102. Fluid ejection die 100 may be embedded in or adhered to carrier 202. Carrier 202 may be a rigid carrier including an epoxy or another suitable material.

Carrier 202 may include a first conductive line 204 electrically coupling a first contact pad (e.g., first high voltage power supply contact pad 118) to a second contact pad (e.g., second high voltage power supply contact pad 124). Carrier 202 may also include a second conductive line 206 electrically coupling a first contact pad (e.g., first high voltage power ground return contact pad 120) to a second contact pad (e.g., second high voltage power ground return contact pad 122).

The first conductive line 204 may be electrically coupled to a first electrical interconnect pad 208, and the second conductive line 206 may be electrically coupled to a second electrical interconnect pad 210. Electrical interconnect pads 208 and 210 may be used to electrically couple fluid ejection device 200 to a fluid ejection system, such as a printer. The electrical interconnect pads 208 and 210 may be used to supply high voltage power from a fluid ejection system to fluid ejection die 100. Additional conductive lines and additional electrical interconnect pads (not shown) may be electrically coupled to the other contact pads of first column 102 and second column 104 to provide electrical connections between fluid ejection die 100 and a fluid ejection system.

Figure 3:
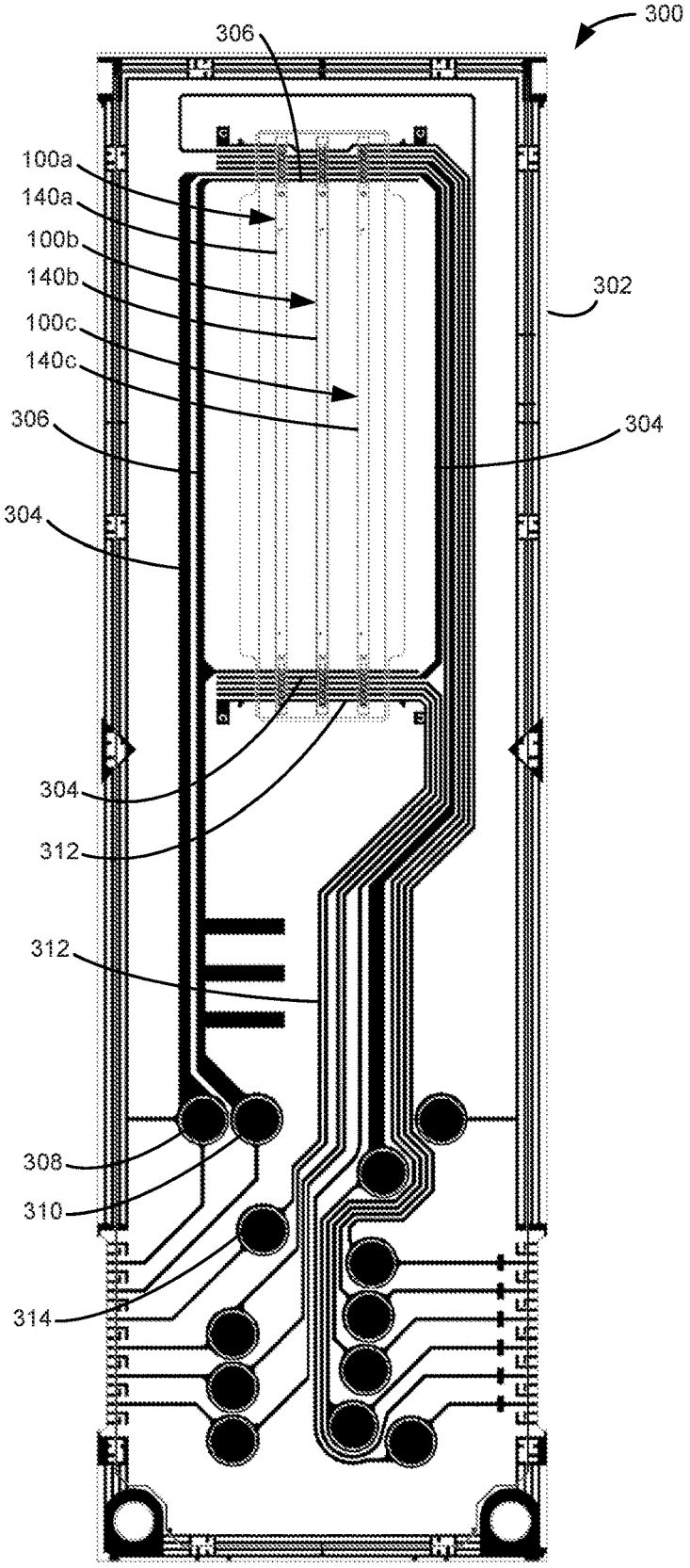
FIG. 3 illustrates another example of a fluid ejection device.

FIG. 3 illustrates another example of a fluid ejection device 300. In one example, fluid ejection device 300 is a printhead assembly for ejecting fluid of three different colors (e.g., cyan, magenta, and yellow). Fluid ejection device 300 includes a carrier 302 and a plurality of fluid ejection dies 100*a*-100*c*. As previously described and illustrated with reference to FIGS. 1A and 1B, each fluid ejection die 100*a*-100*c* includes an elongate substrate 140*a*-140*c*, respectively. The plurality of elongate substrates 140*a*-140*c* are arranged parallel to each other on the carrier 302. Each of the plurality of elongate substrates 140*a*-140*c* may include a single color substrate and each single color substrate may be of a different color. Elongate substrates 140*a*-140*c* may be embedded in or adhered to carrier 302. Carrier 302 may be a rigid carrier including an epoxy or another suitable material.

Carrier 302 includes electrical routing (e.g. conductive lines 304, 306, and 312 described below) to electrical interconnect pads (e.g., electrical interconnect pads 308, 310, and 314 described below) to connect a fluid ejection system circuit (e.g., a printer circuit) to the contact pads of the elongate substrates 140*a*-140*c*. In one example, the electrical routing may be arranged between the elongate substrates 140*a*-140*c*.

Carrier 302 may include a first conductive line 304 electrically coupling a first contact pad of each elongate substrate 140*a*-140*c* (e.g., the first high voltage power supply contact pad 118 of each elongate substrate 140*a*-140*c*) to a second contact pad of each elongate substrate 140*a*-140*c* (e.g., the second high voltage power supply contact pad 124 of each elongate substrate 140*a*-140*c*). Carrier 302 may also include a second conductive line 306 electrically coupling a first contact pad of each elongate substrate 140*a*-140*c* (e.g., first high voltage power ground return contact pad 120 of each elongate substrate 140*a*-140*c*) to a second contact pad of each elongate substrate 140*a*-140*c* (e.g., second high voltage power ground return contact pad 122 of each elongate substrate 140*a*-140*c*).

The first conductive line 304 may be electrically coupled to a first electrical interconnect pad 308, and the second conductive line 306 may be electrically coupled to a second electrical interconnect pad 310. Electrical interconnect pads 308 and 310 may be used to electrically couple fluid ejection device 300 to a fluid ejection system, such as a printer. The electrical interconnect pads 308 and 310 may be used to supply high voltage power from a fluid ejection system to elongate substrates 140*a*-140*c*. Additional conductive lines and additional electrical interconnect pads (e.g. conductive line 312 and electrical interconnect pad 314) may be electrically coupled to the other contact pads of elongate substrates 140*a*-140*c* to provide electrical connections between elongate substrates 140*a*-140*c* and a fluid ejection system. The orientation of the contact pads of elongate substrates 140*a*-140*c* enables the multiple dies to be bonded in parallel with fewer flex wires and connections.

Figure 4:
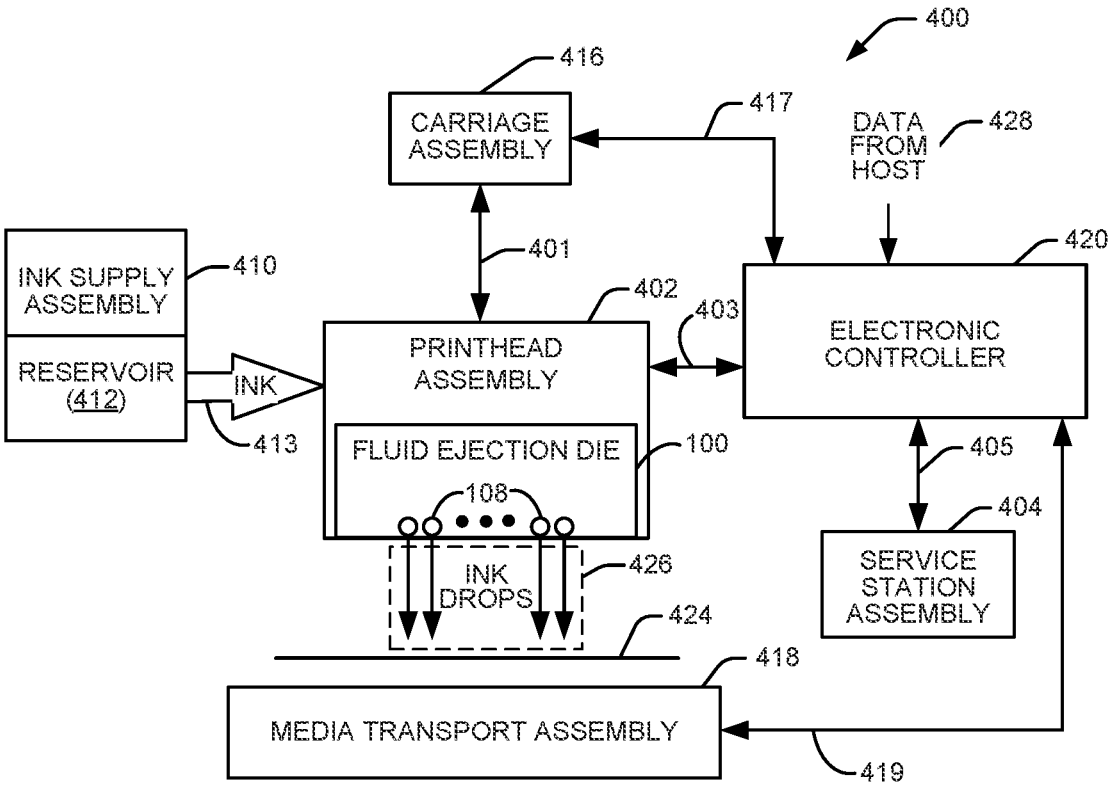
FIG. 4 is a block diagram illustrating one example of a fluid ejection system.

FIG. 4 is a block diagram illustrating one example of a fluid ejection system 400. Fluid ejection system 400 includes a fluid ejection assembly, such as printhead assembly 402, and a fluid supply assembly, such as ink supply assembly 410. In one example, printhead assembly 402 may include a fluid ejection device 200 of FIG. 2 or a fluid ejection device 300 of FIG. 3. In the illustrated example, fluid ejection system 400 also includes a service station assembly 404, a carriage assembly 416, a print media transport assembly 418, and an electronic controller 420. While the following description provides examples of systems and assemblies for fluid handling with regard to ink, the disclosed systems and assemblies are also applicable to the handling of fluids other than ink.

Printhead assembly 402 includes at least one printhead or fluid ejection die 100 previously described and illustrated with reference to FIGS. 1A and 1B, which ejects drops of ink or fluid through a plurality of orifices or nozzles 108. In one example, the drops are directed toward a medium, such as print media 424, so as to print onto print media 424. In one example, print media 424 includes any type of suitable sheet material, such as paper, card stock, transparencies, Mylar, fabric, and the like. In another example, print media 424 includes media for three-dimensional (3D) printing, such as a powder bed, or media for bioprinting and/or drug discovery testing, such as a reservoir or container. In one example, nozzles 108 are arranged in at least one column or array such that properly sequenced ejection of ink from nozzles 108 causes characters, symbols, and/or other graphics or images to be printed upon print media 424 as printhead assembly 402 and print media 424 are moved relative to each other.

Ink supply assembly 410 supplies ink to printhead assembly 402 and includes a reservoir 412 for storing ink. As such, in one example, ink flows from reservoir 412 to printhead assembly 402. In one example, printhead assembly 402 and ink supply assembly 410 are housed together in an inkjet or fluid-jet print cartridge or pen. In another example, ink supply assembly 410 is separate from printhead assembly 402 and supplies ink to printhead assembly 402 through an interface connection 413, such as a supply tube and/or valve.

Carriage assembly 416 positions printhead assembly 402 relative to print media transport assembly 418, and print media transport assembly 418 positions print media 424 relative to printhead assembly 402. Thus, a print zone 426 is defined adjacent to nozzles 108 in an area between printhead assembly 402 and print media 424. In one example, printhead assembly 402 is a scanning type printhead assembly such that carriage assembly 416 moves printhead assembly 402 relative to print media transport assembly 418. In another example, printhead assembly 402 is a non-scanning type printhead assembly such that carriage assembly 416 fixes printhead assembly 402 at a prescribed position relative to print media transport assembly 418.

Service station assembly 404 provides for spitting, wiping, capping, and/or priming of printhead assembly 402 to maintain the functionality of printhead assembly 402 and, more specifically, nozzles 108. For example, service station assembly 404 may include a rubber blade or wiper which is periodically passed over printhead assembly 402 to wipe and clean nozzles 108 of excess ink. In addition, service station assembly 404 may include a cap that covers printhead assembly 402 to protect nozzles 108 from drying out during periods of non-use. In addition, service station assembly 404 may include a spittoon into which printhead assembly 402 ejects ink during spits to ensure that reservoir 412 maintains an appropriate level of pressure and fluidity, and to ensure that nozzles 108 do not clog or weep. Functions of service station assembly 404 may include relative motion between service station assembly 404 and printhead assembly 402.

Electronic controller 420 communicates with printhead assembly 402 through a communication path 403, service station assembly 404 through a communication path 405, carriage assembly 416 through a communication path 417, and print media transport assembly 418 through a communication path 419. In one example, when printhead assembly 402 is mounted in carriage assembly 416, electronic controller 420 and printhead assembly 402 may communicate via carriage assembly 416 through a communication path 401. Electronic controller 420 may also communicate with ink supply assembly 410 such that, in one implementation, a new (or used) ink supply may be detected.

Electronic controller 420 receives data 428 from a host system, such as a computer, and may include memory for temporarily storing data 428. Data 428 may be sent to fluid ejection system 400 along an electronic, infrared, optical or other information transfer path. Data 428 represent, for example, a document and/or file to be printed. As such, data 428 form a print job for fluid ejection system 400 and includes at least one print job command and/or command parameter.

In one example, electronic controller 420 provides control of printhead assembly 402 including timing control for ejection of ink drops from nozzles 108. As such, electronic controller 420 defines a pattern of ejected ink drops which form characters, symbols, and/or other graphics or images on print media 424. Timing control and, therefore, the pattern of ejected ink drops, is determined by the print job commands and/or command parameters. In one example, logic and drive circuitry forming a portion of electronic controller 420 is located on printhead assembly 402. In another example, logic and drive circuitry forming a portion of electronic controller 420 is located off printhead assembly 402.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A device comprising:

a first column of contact pads; and a column of fluid actuation devices disposed longitudinally to the first column of contact pads, wherein the first column of contact pads is longitudinally aligned with the column of fluid actuation devices.

2. The device of claim 1, further comprising:

a second column of contact pads aligned with the first column of contact pads and at a distance from the first column of contact pads.

3. The device of claim 2, wherein the column of fluid actuation devices is arranged between the first column of contact pads and the second column of contact pads.

4. The device of claim 3, wherein the first column of contact pads comprises six contact pads, and wherein the second column of contact pads comprises six contact pads.

5. The device of claim 3, wherein the first column of contact pads comprises a first high voltage power supply contact pad and a first high voltage power ground return contact pad, and wherein the second column of contact pads comprises a second high voltage power supply contact pad and a second high voltage power ground return contact pad.

6. The device of claim 3, wherein the first column of contact pads comprises a logic power ground return contact pad, and wherein the second column of contact pads comprises a logic power supply contact pad.

7. The device of claim 3, wherein the first column of contact pads comprises a data contact pad, a clock contact pad, and a multipurpose input/output contact pad, and wherein the second column of contact pads comprises a logic reset contact pad, a mode contact pad, and a fire contact pad.

8. The device of claim 1, further comprising:

an elongate substrate having a length, a thickness, and a width, wherein the length is at least twenty times the width, and wherein the first column of contact pads and the column of fluid actuation devices are arranged along the length of the elongate substrate.

9. A fluid ejection die comprising:

a first column of contact pads;

a second column of contact pads aligned with the first column of contact pads; and a column of fluid actuation devices between the first column of contact pads and the second column of contact pads, wherein the first column of contact pads, the second column of contact pads, and the column of fluid actuation devices are longitudinally aligned.

10. The fluid ejection die of claim 9, wherein the first column of contact pads comprises a first high voltage power ground return contact pad at the bottom of the first column, and wherein the second column of contact pads comprises a second high voltage power ground return contact pad at the top of the second column.

11. The fluid ejection die of claim 10, wherein the first column of contact pads comprises a first high voltage power supply contact pad directly above the first high voltage power ground return contact pad, and wherein the second column of contact pads comprises a second high voltage power supply contact pad directly below the second high voltage power ground return contact pad.

12. The fluid ejection die of claim 9, wherein the first column of contact pads comprises a logic power ground return contact pad, and wherein the second column of contact pads comprises a logic power supply contact pad.

13. The fluid ejection die of claim 9, wherein the first column of contact pads comprises a data contact pad at the top of the first column, and wherein the second column of contact pads comprises a fire contact pad at the bottom of the second column.

14. The fluid ejection die of claim 9, wherein the first column of contact pads comprises the following contact pads in order: a data contact pad, a clock contact pad, a logic power ground return contact pad, a multipurpose input/output contact pad, a first high voltage power supply contact pad, and a first high voltage power ground return contact pad, and wherein the second column of contact pads comprises the following contact pads in order: a second high voltage power ground return contact pad, a second high voltage power supply contact pad, a logic reset input contact pad, a logic power supply contact pad, a mode contact pad, and a fire contact pad.

15. The fluid ejection die of claim 9, further comprising:

an elongate substrate having a length, a thickness, and a width, wherein the length is at least twenty times the width, and wherein the first column of contact pads, the second column of contact pads, and the column of fluid actuation devices are arranged along the length of the elongate substrate.

* * * * *